US010172185B2

(12) United States Patent
Dudar et al.

(10) Patent No.: US 10,172,185 B2
(45) Date of Patent: Jan. 1, 2019

(54) SELECTIVE HEATING OF VEHICLE SIDE WINDOW

(71) Applicant: FORD GLOBAL TECHNOLOGIES, LLC, Dearborn, MI (US)

(72) Inventors: Aed M. Dudar, Canton, MI (US); Mahmoud Yousef Ghannam, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 574 days.

(21) Appl. No.: 14/589,122

(22) Filed: Jan. 5, 2015

(65) Prior Publication Data

US 2016/0198525 A1 Jul. 7, 2016

(51) Int. Cl.
*H05B 1/02* (2006.01)

(52) U.S. Cl.
CPC ..... *H05B 1/0236* (2013.01)

(58) Field of Classification Search
CPC ..... H05B 3/84; H05B 2203/002; H05B 3/06; H05B 2203/003; H05B 2203/014; H05B 2203/017; H05B 2203/031; H05B 2203/033; H05B 3/36; H05B 3/86; H05B 1/0236; H05B 2203/013; B60S 1/026; B60S 1/54
USPC ..... 219/202, 203, 214, 477, 478–480, 518, 219/522, 541
See application file for complete search history.

(56) References Cited

U.S. PATENT DOCUMENTS

| | | | | |
|---|---|---|---|---|
| 5,791,407 | A * | 8/1998 | Hammons | B60H 1/2221 123/142.5 E |
| 7,783,400 | B1 | 8/2010 | Zimler | |
| 8,530,792 | B2 | 9/2013 | Dyrdek | |
| 8,831,808 | B2 | 9/2014 | Stanek et al. | |
| 2004/0021575 | A1* | 2/2004 | Oskorep | B60S 1/026 340/601 |
| 2008/0067974 | A1* | 3/2008 | Zhang | H02J 7/022 320/104 |
| 2009/0050614 | A1* | 2/2009 | Renke | H05B 3/84 219/203 |
| 2014/0217194 | A1* | 8/2014 | Han | B60S 1/488 239/1 |
| 2014/0277869 | A1 | 9/2014 | King et al. | |

FOREIGN PATENT DOCUMENTS

| | | |
|---|---|---|
| CN | 203805428 | 9/2014 |
| DE | 102012207925 | 11/2013 |
| JP | 06219151 | 8/1994 |

OTHER PUBLICATIONS

EZ Heat Reusable Hand Warmers, description of product retrieved on Dec. 17, 2014 from http://www.rewci.com/ez-heat-reusable-hand-warmer.html?gclid=CJXasoSJwclCFWc.

* cited by examiner

*Primary Examiner* — Tu B Hoang
*Assistant Examiner* — Joseph Baillargeon
(74) *Attorney, Agent, or Firm* — Carlson, Gaskey & Olds, P.C.

(57) ABSTRACT

An exemplary assembly includes a side window moveable between a first position and a second position, a heating element that selectively heats the side window, the heating element generating more heat when the side window is in the first position than when the side window is in the second position.

7 Claims, 2 Drawing Sheets

SELECTIVE HEATING OF VEHICLE SIDE WINDOW

TECHNICAL FIELD

This disclosure is directed toward selectively heating side windows of a vehicle and, more particularly, to selectively heating side windows to melt ice, to inhibit ice formation, or both.

BACKGROUND

Generally, electrified vehicles differ from conventional motor vehicles because electrified vehicles can be selectively driven using one or more battery-powered electric machines. Conventional motor vehicles, by contrast, are driven exclusively by an internal combustion engine. Electric machines can drive the electrified vehicles instead of, or in addition to, the internal combustion engines. Example electrified vehicles include all-electric vehicles, hybrid electric vehicles (HEVs), plug-in hybrid electric vehicles (PHEVs), fuel cell vehicles, and battery electric vehicles (BEVs).

Low temperatures can lead to ice forming on the windows of electrified vehicles and other types of vehicles. Ice can undesirably impair vision through the windows. Side windows of vehicles typically lack wipers or defrost elements.

SUMMARY

An assembly according to an exemplary aspect of the present disclosure includes, among other things, a side window moveable between a first position and a second position. A heating element selectively heats the side window. The heating element generates more heat when the side window is in the first position than when the side window is in the second position.

In a further non-limiting embodiment of the foregoing assembly, the first position is a closed position and the second position is an open position.

In a further non-limiting embodiment of any of the foregoing assemblies, the heating element generates heat exclusively when the window is in the first position.

In a further non-limiting embodiment of any of the foregoing assemblies, at least a portion of the heating element is contained within a seal that is adjacent the side window.

In a further non-limiting embodiment of any of the foregoing assemblies, the seal is exterior to a vehicle having the side window.

In a further non-limiting embodiment of any of the foregoing assemblies, the assembly includes a circuit that includes a power supply and the heating element. Continuity through the circuit is maintained when the side window is in the first position. The circuit is open and continuity is disrupted when the side window in the second position.

In a further non-limiting embodiment of any of the foregoing assemblies, the assembly includes a switch that is closed when the side window is in the first position to maintain continuity through the circuit. The switch is open when the side window is in the second position to disrupt continuity through the circuit.

In a further non-limiting embodiment of any of the foregoing assemblies, the power supply is configured to draw power from an electrical grid.

In a further non-limiting embodiment of any of the foregoing assemblies, the heating element selectively heats the side window exclusively when a vehicle having the side window is parked.

In a further non-limiting embodiment of any of the foregoing assemblies, the assembly includes a controller. The heating element selectively heats the side window in response to a command from the controller.

In a further non-limiting embodiment of any of the foregoing assemblies, the controller communicates the command at least in part in response to environmental data communicated from sensors on a vehicle having the side window.

In a further non-limiting embodiment of any of the foregoing assemblies, the controller communicates the command at least in part in response to environmental data communicated to the vehicle from an information cloud.

A method according to another exemplary aspect of the present disclosure includes, among other things, generating more heat to heat a side window of a vehicle when the side window is in a first position than when the side window is in a second position.

In a further non-limiting embodiment of the foregoing method, the first position is a closed position and the second position is an open position.

In a further non-limiting embodiment of any of the foregoing methods, no heat is generated to heat the side window when the side window is in the second position.

In a further non-limiting embodiment of any of the foregoing methods, the method includes maintaining continuity through a circuit that includes a side window heating element when the side window is in the first position, and opening the circuit to disrupt continuity when the side window in the second position.

In a further non-limiting embodiment of any of the foregoing methods, moving the window from the first position to the second position disrupts continuity through the circuit.

In a further non-limiting embodiment of any of the foregoing methods, the method includes generating heat to heat the side window in response to a command from a controller, the controller providing the command at least in part in response to environmental data communicated from sensors on the vehicle.

In a further non-limiting embodiment of any of the foregoing methods, the method includes generating heat to heat the side window in response to a command from a controller, the controller providing the command at least in part in response to environmental data from an information cloud.

The embodiments, examples and alternatives of the preceding paragraphs, the claims, or the following figures and description, including any of their various aspects or respective individual features, may be taken independently or in any combination. Features described in connection with one embodiment are applicable to all embodiments, unless such features are incompatible.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure relates generally to selectively heating a side window to, among other things, remove ice from the side window prior to a drive cycle.

A heating element selectively heats the side window when the side window is closed. The heating element selectively heats the side window when conditions are favorable for ice formation.

The heating element may be blocked from heating the side window if the side window is open, or a door is open. Blocking heating when the side window or door is open prevents, among other things, melted ice from entering a passenger compartment of the vehicle.

Figure 1:
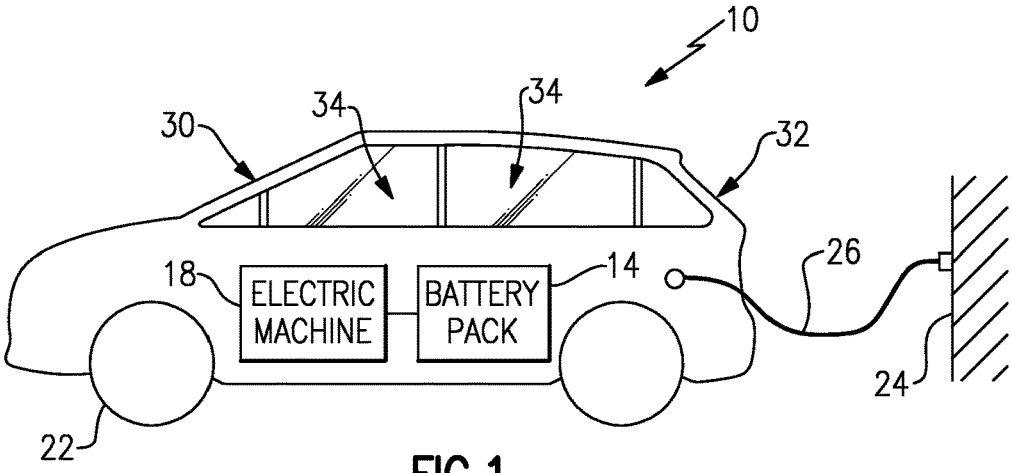
FIG. 1 shows a partially schematic view of an electrified vehicle.

Referring to FIG. 1, an example electrified vehicle 10 includes a battery pack 14 to power an electric machine 18. The vehicle includes wheels 22 driven by the electric machine 18. The electric machine 18 receives electric power from the battery pack 14 and converts the electric power to torque.

The example vehicle 10 is an all-electric vehicle. In other examples, vehicle 10 is a hybrid electric vehicle, which selectively drives the wheels 22 using an internal combustion engine instead of, or in addition to, the electric machine 18. In hybrid electric examples, the electric machine 18 may selectively operate as a generator to recharge the battery pack 14.

When the vehicle 10 is parked, the vehicle 10 may draw power from a wall source 24 through a plug 26. Power from the wall source 24 can be used to, among other things, recharge the battery pack 14 or to condition the vehicle when the vehicle 10 is parked. The wall source 24 is part of an electric grid.

The example vehicle 10 includes a front window 30 or windshield, a rear window 32, and a plurality of side windows 34. The side windows 34 are located at the lateral outboard sides of the vehicle 10. The front window 30 and the rear window 32 are located at the front and rear of the vehicle, respectively. The side windows 34 can be actuated back and forth between open and close positions.

Conditioning the vehicle 10 prior to a drive cycle may include activating heating elements to melt ice or inhibit ice formation on the front window 30, the rear window 32, and the side windows 34. If the side windows 34 are partially open, melting ice may enter an interior of the vehicle 10 as water, which is undesirable. The example vehicle 10 includes features to limit heating of the side windows 34 if heating the side windows 34 could cause water to enter the vehicle 10.

In some examples, the vehicle 10 can be programmed to be conditioned at a particular time. For example, if a driver of the vehicle 10 plans to begin a drive cycle every day at 7:00 a.m., the vehicle 10 may be programmed to "wake-up" at 6:30 a.m. and begin to condition the vehicle 10 in preparation for the drive cycle.

In addition to melting ice and inhibiting ice formation, conditioning the vehicle 10 may include raising a temperature within a passenger compartment of the vehicle 10 prior to beginning a drive cycle. Conditioning may further include heating the battery pack 14 to enhance efficiency of the battery pack 14 during a drive cycle.

Figure 2:
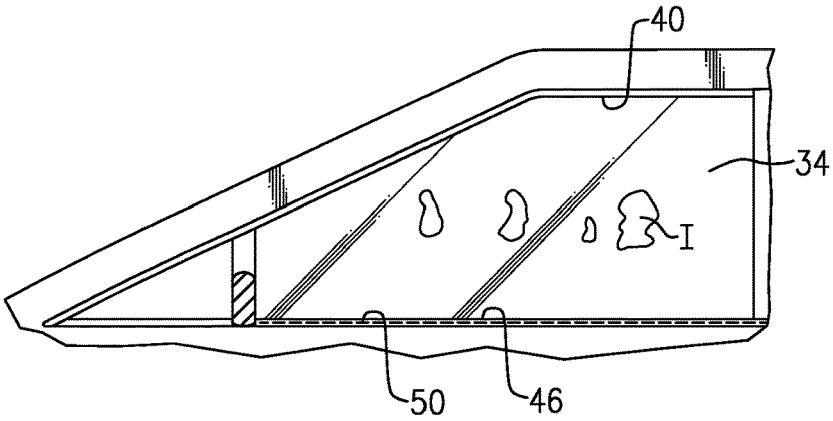
FIG. 2 shows a close-up view of a side window from the vehicle of FIG. 1 in a closed position.
Figure 3:
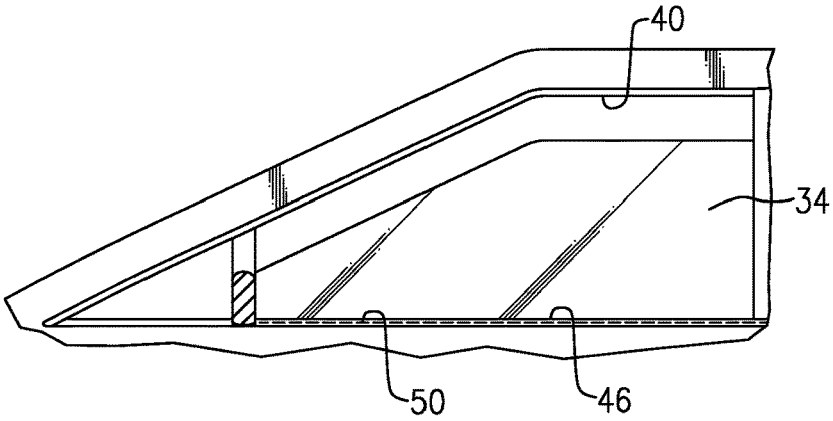
FIG. 3 shows a close-up view of the side window from the vehicle of FIG. 1 in an open position.

Referring now to FIGS. 2 and 3 with continuing reference to FIG. 1, a seal assembly 40 or weather strip surrounds a side window opening. The side windows 34 fill the respective side window openings when the side windows 34 are closed. The seal assembly 40 prevents water and contaminants from entering the passenger compartment when the side windows 34 are closed.

The seal assembly 40 includes a belt line seal 46. In this example, a heating element 50 is embedded within the belt line seal 46. The heating element 50 may be embedded within the belt line seal 46 at a location where the side window 34 contacts the belt line seal 46.

The heating element 50 generates thermal energy when current flows to the heating element 50. The heating element 50 can be a heat wire, heat tape, or some other heating element capable of generating thermal energy when provided with electrical power. Other examples of the heating element 50 can include a silicone element, metal element, ceramic element, composite element, or fluid. The fluid can flow through channels in the belt line seal 46 or another component.

The heating element 50 is not limited to elements powered with electrical power can include elements powered by magnetic energy, light, radiation, or other type of power source. The heating element 50 could further include a phase change material that is charged with thermal energy, which is stored within the heating element 50 until relatively cold air flows through a portion of the heating element 50 to release the heat.

In some examples, the belt line seal 46 is a molded polymer, and the heating element 50 is molded within the belt line seal 46. In other examples, the heating element 50 may be applied to an exterior surface of the belt line seal 46 via an adhesive, for example.

The heating element 50 can be completely contained within the belt line seal 46. In other examples, the heating element 50 is partially, or completely, exposed.

Although the example heating element 50 is shown and described in connection with the belt line seal 46, the heating element 50 may be located elsewhere in other examples. The heating element 50 could, for example, be contained within another portion of the seal assembly 40, or in an area of the vehicle 10 other than the seal assembly 40, such as within a metallic structure of a vehicle door or within the side window 34.

Powering the heating element 50 causes the heating element 50 to generate heat. Heat from the heating element heats the side window 34. Heating the side window 34 with the heating element 50 can melt ice I adhered to the side window 34. Heating the side window 34 can further and inhibit the formation of additional ice I on the side window 34.

Figure 4:
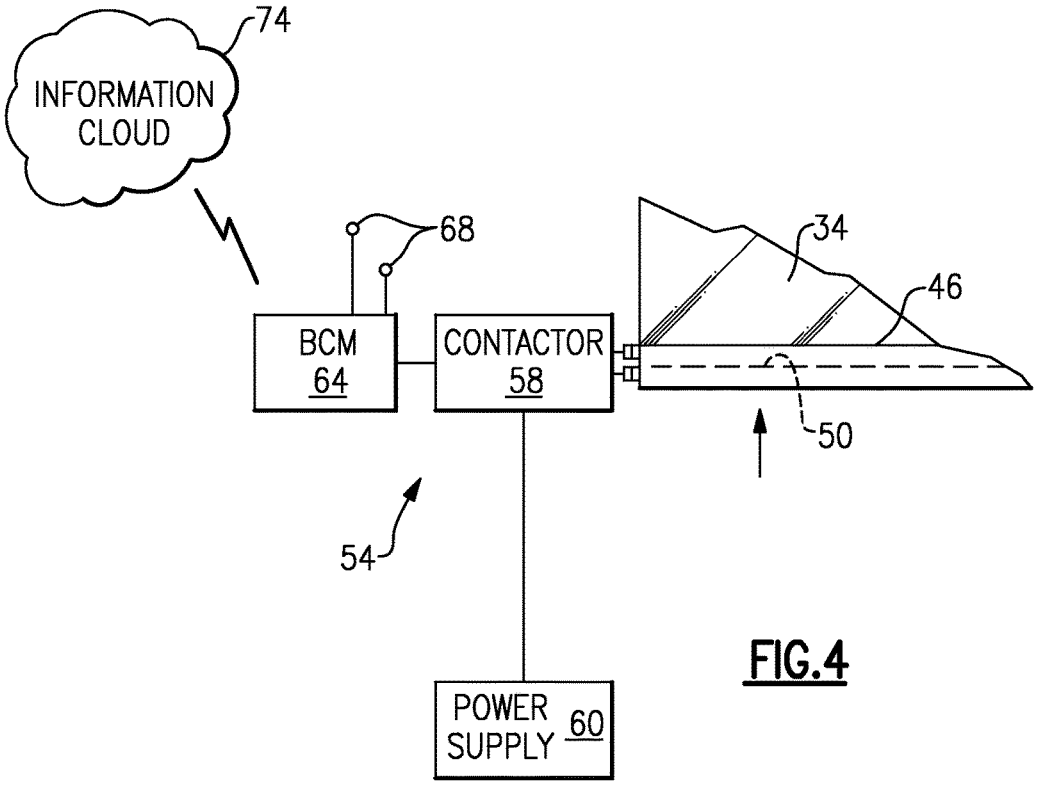
FIG. 4 shows a side window heating assembly of the vehicle of FIG. 1 when the side window is in the closed position of FIG. 2.
Figure 5:
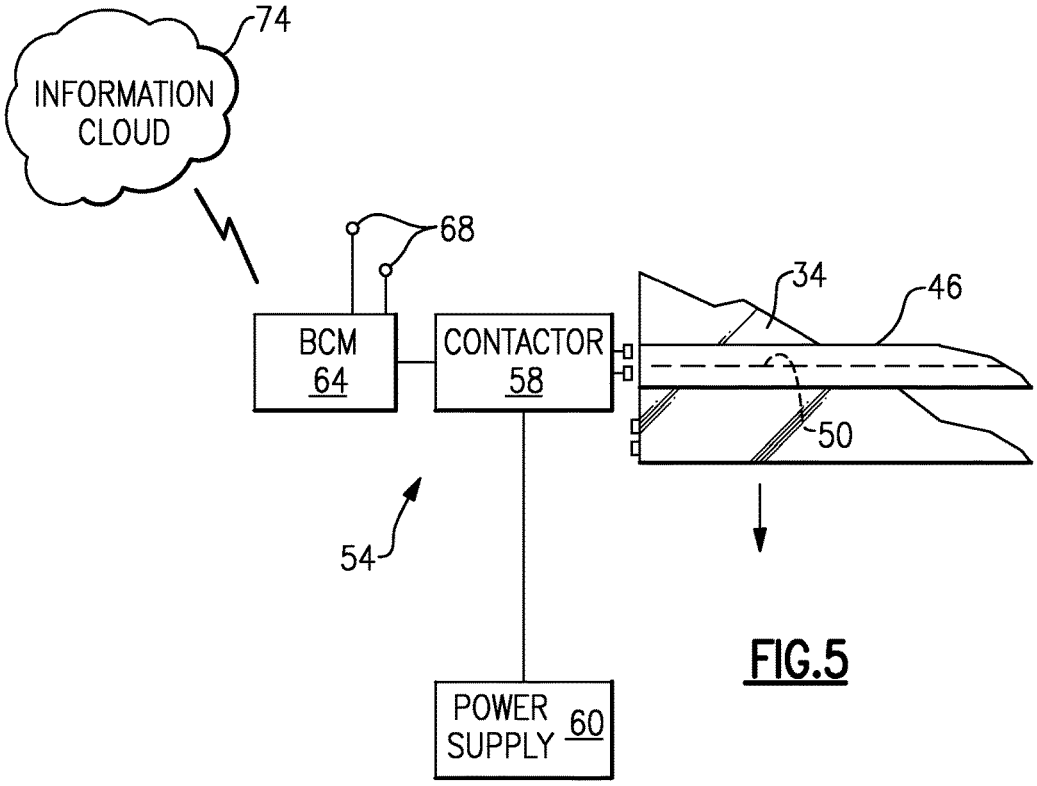
FIG. 5 shows the side window heating assembly of the vehicle of FIG. 1 when the side window is in the open position of FIG. 3.

Referring now to FIGS. 4 and 5 with continuing reference to FIGS. 1 to 3, the heating element 50 is one portion of a side window heating assembly 54. The side window heating assembly 54 further includes a contactor 58 coupled to a power supply 60, such as the wall source 24 of FIG. 1.

A battery control module (BCM) 64 of the vehicle 10 is operatively coupled to the contactor 58. The BCM 64 sends commands cause power to flow from the power supply 60 to the contactor 58 when, for examples, conditions are appropriate for ice formation on the side window 34. The BCM 64 may additionally power other heating elements associated with the front window 30, the rear window 32, or both.

A person having skill in this art and the benefit of this disclosure could understand how to command the power supply 60 to send power to the contactor 58 in response to a command from the BCM 64.

The BCM 64 may rely on weather information to determine if the contactor 58 should receive power.

In some examples, the BCM 64 obtains weather condition information from sensors 68 mounted to the vehicle 10. The sensors 68 can include temperature sensors, humidity sensors, such as thermistors within the belt line seal 46 or another portion of the vehicle 10. Other types of sensor capable of collecting information relevant to ice formation may include cameras with intelligent vision software, radars, rain sensors, infrared sensors etc.

In some examples, the BCM 64 instead, or additionally, receives weather condition information from an information cloud 74 that is separate from the vehicle 10. The weather information may be associated with the location of the vehicle 10. The weather information may include temperatures, humidity levels, future temperatures, future humidity levels, or some combination of these.

The BCM 64 may obtain future weather information from the information cloud 74 during a key off cycle. If, for example, a temperature drop, rain, snow, or some combination of these is expected at the location of the vehicle, the BCM 64 automatically schedules a wake-up a certain number of hours after the key-off.

When the BCM 64 wakes up, the BCM 64 may then retrieve information from the sensors 68, the information cloud 74, or both, to confirm whether ice formation on the side windows 34 is likely. If so, the BCM 64 sends power to the contactor 58. The BCM 64 may then schedule another wake-up at a later time if future weather conditions continue to indicate that ice formation on the side windows 34 is likely.

In so doing, the BCM 64 continually melts ice on the side window 34 when the vehicle 10 is parked via multiple wake-ups and de-icing sessions. This prevents substantial build-ups of ice on the side windows 34 so that a driver of the vehicle 10 does not encounter side windows 34 that are frozen shut when returning to the vehicle 10 for a drive cycle.

The information cloud 74 may instead report to the BCM 64 that conditions are favorable for ice formation in the location of the vehicle 10 rather than reporting specific variables like temperature and humidity. In such an example, the BCM 64 may not calculate whether conditions are favorable for ice formation and instead responses to the report from the information cloud 74. Calculations about whether conditions are favorable for ice formation take place within the information cloud 74 or at another location remote from the vehicle 10.

If weather conditions are favorable for ice on the side window 34, the BCM 64 commands power to move from the power supply 60 to contactor 58.

If the side window 34 is in the closed position of FIGS. 2 and 3, power from the power supply 60 will flow through the contactor 58 to the heating element 50 to melt ice on the side window 34 or mitigate ice formation on the side window 34. After expiration of a timer, or a response from a thermistor sensor, the BCM 64 may discontinue sending power to the contactor 58.

If the side window 34 is moved from the closed position of FIGS. 2 and 4 to the open position of FIGS. 3 and 5, the contactor 58 is open and power is unable to move through the contactor 58 to the heating element 50. The contactor 58 is opened when the side window 34 is not in the closed position. This prevents the heating element 50 from heating the side window 34 when the side window 34 is not in the closed position. The heating element 50 is thus selectively powered based on the positioning of the side window 34.

When the side window 34 is in the closed position, a circuit between the power supply 60, the contactor 58 and the heating element 50 maintains continuity. Moving the side window from the closed position disrupts continuity through the circuit.

In some examples, the BCM 64 may sense that the power supply 60 is unable to communicate power through the contactor 58 to the heating element 50. In response, the BCM 64 may send a message wirelessly to an operator of the vehicle 10 notifying the operator that the side window 34 is not in a closed position. The operator may then elect to move the side window 34 to a closed position so that heating the side window 34 with the heating element 50 is possible. The operator may move the side window 34 to the closed position remotely, or from a location within the vehicle 10.

The example BCM 64 periodically sends power to the contactor 58 from the power supply 60, which is wall source 24, when the vehicle 10 is off. In other examples, the BCM 64 sends power to the contactor 58 from another power supply, such as the battery pack 14. The battery pack 14 may be monitored to ensure that sending power to the contactor 58 does not deplete power in the battery pack 14 below a threshold level.

The example BCM 64 can send power to the contactor 58 from the power supply 60 during a conditioning cycle. If the vehicle 10 is programmed to "wake-up" at 6:30 a.m. and begin to condition the vehicle 10 in preparation for the drive cycle, the vehicle 10 may "wake-up" earlier than 6:30 a.m. if conditions are favorable for ice so that the BCM 64 can send power to the contactor 58. Identifying weather conditions favorable for ice formation thus may result in an earlier wake-up or go-time for the vehicle 10.

Although the contactor 58 is incorporated in the above examples, other devices could be used to ensure that the heating element 50 is not powered when the side window 34 is in an open position. For example, a no-contact system incorporating proximity sensors could be used instead of, or in addition, to the contactor 58. The proximity sensor can detect the presence of nearby objects, such as the presence of a portion of the side window 34 corresponding to the side window 34 being in an up position. The heating element 50 is then powered when that portion of the side window 34 is detected. If that portion of the side window 34 is not detected, the heating element 50 is not powered.

In other examples, other types of non-contact displacement fast response sensors may be used. Such sensors can measure the distance between a fixed location and a portion of the side window 34. If the distance is above a threshold distance, the side window 34 is assumed to not be in a closed position and heating element 50 is prevented from receiving power.

Preventing the heating element 50 from receiving power may be accomplished in ways other than by interrupting the continuity of a circuit including the heating element 50. For example, the non-contact displacement fast response sensor, or another type of sensor, may communicate an electronic signal to the BCM 64 that the side window 34 is not closed. In response to this information, the BCM 64 cancels the communication of power to the heating element 50.

In addition to preventing the heating element 50 from receiving power when the side window 34 is open, the heating element 50 may instead, or additionally, be prevented from receiving power when a door of the vehicle 10 is open, particularly the door associated having the heating element 50. Devices such as the contactor 58 and various sensors described above could be used to determine when the door of the vehicle 10 is open.

Notably, opening and closing the door changes the position of the side window 34. Thus, selective heating of the heating element 50 can still be considered to be based on positioning of the side window 34.

Features of the disclosed examples include a heating element that selectively heats a side window of a vehicle to prevent or inhibit ice formation. The heating element provides such heat when the side window is in certain positions. Moving the side window to other positions prevents the heating element from providing heat to the side window.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A method, comprising:

generating more heat with a heating element to heat a side window of a vehicle when the side window is in a first position than when the side window is in a second position where the side window is more open than the first position; and waking a control module that commands the generating during a key off cycle and waking the control module again during the same key off cycle.

2. The method of claim 1, wherein the first position is a closed position and the second position is an open position.

3. The method of claim 1, wherein no heat is generated to heat the side window when the side window is in the second position.

4. The method of claim 1, further comprising maintaining continuity through a circuit that includes the heating element when the side window is in the first position, and opening the circuit to disrupt continuity when the side window in the second position.

5. The method of claim 4, wherein moving the window from the first position to the second position disrupts continuity through the circuit.

6. The method of claim 1, wherein the control module commands the generating at least in part in response to environmental data communicated from sensors on the vehicle.

7. The method of claim 1, wherein the control module commands the generating at least in part in response to environmental data from an information cloud.

* * * * *